US006328092B1

(12) United States Patent
Guetlbauer et al.

(10) Patent No.: US 6,328,092 B1
(45) Date of Patent: Dec. 11, 2001

(54) PROCESS AND A SYSTEM FOR CONNECTING AT LEAST TWO COMPONENTS

(75) Inventors: Franz Guetlbauer, Neufahrn; Hartmut Hoffmann, Bad Wimpfen; Arno Jambor, Vaihingen; Volker Thoms, Calw, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/247,604

(22) Filed: Feb. 10, 1999

(30) Foreign Application Priority Data

Feb. 10, 1998 (DE) ..... 198 05 175

(51) Int. Cl.[7] ..... B22D 19/00
(52) U.S. Cl. ..... 164/98; 164/108; 164/111
(58) Field of Search ..... 164/98, 108, 111

(56) References Cited

U.S. PATENT DOCUMENTS

| | | | | |
|---|---|---|---|---|
| 982,265 | | 1/1911 | Gale | 5/283 |
| 1,021,437 | | 3/1912 | Vallone | 249/83 |
| 4,487,456 | * | 12/1984 | Zulauf | 301/63 R |
| 4,545,419 | | 10/1985 | Zulauf | 164/111 |

FOREIGN PATENT DOCUMENTS

| | | | | |
|---|---|---|---|---|
| 650 956 | | 8/1985 | (CH) . | |
| 650956 | * | 8/1985 | (CH) | 164/98 |
| 1 811 010 | | 5/1970 | (DE) . | |
| 30 09 080 | | 8/1981 | (DE) . | |
| 32 05 952 | | 3/1983 | (DE) . | |
| 35 13 718 | | 10/1986 | (DE) . | |
| 41 03 036 | | 8/1992 | (DE) . | |
| 196 23 463 | | 12/1997 | (DE) . | |
| 0 335 856 | | 10/1989 | (EP) . | |
| 56-045259 | | 6/1981 | (JP) . | |

OTHER PUBLICATIONS

G. Schwietzke, "Die technischen und wirtschaftlichen Grundlagen von NE–Schwermetall–Verbundguss", 1953, p. 8.

Dr. F. Roll, "Handbuch der Giesserei–Technik", 1963, p. 237.

Jay, Fred H., "Joining Parts by Die Casting", Machine Design, vol. 43, Apr. 1971, pp. 93–95.

* cited by examiner

*Primary Examiner*—Nam Nguyen
*Assistant Examiner*—I.-H. Lin
(74) *Attorney, Agent, or Firm*—Crowell & Moring LLP

(57) ABSTRACT

A process for connecting at least two components, particularly body components of motor vehicles, wherein the first component has an undercut on a side facing the second component. In the area of the undercut, a connection piece is cast to the first component. The connection piece is designed such that, during its solidification, the connection piece is firmly connected with the first component by the contraction of a last-solidifying core area of the connection piece. Then the second component is mounted on the connection piece.

17 Claims, 3 Drawing Sheets

PROCESS AND A SYSTEM FOR CONNECTING AT LEAST TWO COMPONENTS

BACKGROUND AND SUMMARY OF THE INVENTION

This application claims the priority of German patent 198 05 175.1-24, filed Feb. 10, 1998, the disclosure of which is expressly incorporated by reference herein.

The invention relates to a process and a system for connecting at least two components, particularly body components of motor vehicles, wherein the first component has an under cut on a side facing the second component.

In the vehicle body construction of motor vehicles, according to a prior art known from practice, two components, particularly side members and cross members which abut with one another in a T-shape, are connected with one another by welding. However, these very customary welded connections have the disadvantage that very large weld seams are required for this purpose and the two parts to be connected with one another may become extremely warped because of the effect of heat. The dimensional accuracy of the whole vehicle body structure which is created by the connection of several components with one another can therefore not be raised to a very high level.

From German Patent Document DE-OS 1 811 010, a process is known for the mutual connection of two metal parts, which are provided on their abutting surfaces with mutually opposite recesses which expand toward the inside. When the metal parts are joined, these recesses form a cohesive hollow space. For connecting the two parts, heated metal is charged into this hollow space. This metal shrinks when cooling and thus pulls the metal parts together.

If the components are simple, the process described in that document may be suitable for a connection. However, because of the complicated structures occurring in the construction of vehicle bodies, it cannot be used appropriately.

U.S. Pat. No. 982,265 describes a process for joining a rod to a tube. Metal is poured into the tube and the rod is thus connected with the tube.

Furthermore, from U.S. Pat. No. 1,021,437, a connection is known for two tubes which is created by pouring liquid metal into the connection area of the two tubes which mutually abut in a T-shape.

It is an object of the present invention, to provide a process for connecting two components which represents a simple, secure connection, particularly in the vehicle body construction field and is suitable for a series production.

According to the invention, this and other objects have been achieved by providing a process for connecting a first motor vehicle component to a second motor vehicle component, the first component having an undercut on a side facing the second component, said process comprising the steps of: casting a connection piece onto said first component such that a portion of the connection piece extends into the undercut of the first component, a last-solidifying core area of said connection piece contracting to firmly connect the connection piece with the first component; and mounting the second component on the connection piece.

According to the invention, this and other objects have also been achieved by providing a process for connecting a motor vehicle body cross member to a motor vehicle body side member, said side member defining an undercut on a side facing said cross member, said process comprising:

arranging a casting mold adjacent said undercut, said casting mold defining at least one mold space for forming a connection piece including a mounting area for mounting the cross member; flowing a molten material into said at least one mold space of the casting mold to form said connection piece, a portion of the molten material flowing into the undercut of the side member to form a connection between the connection piece and the side member after the molten material solidifies; and mounting said cross member on said mounting area of the connection piece.

According to the invention, this and other objects have also been achieved by providing a system for connecting at least two motor vehicle body members, comprising: a motor vehicle body cross member; a motor vehicle body side member defining an undercut on a side facing said cross member; a casting mold defining at least one mold space for forming a connection piece including a mounting area for mounting the cross member, said connection piece being cast onto said side member such that a portion of the connection piece extends into the undercut of the side member to connect the connection piece with the side member; and said cross member being mounted on said mounting area of the connection piece.

According to the invention, this and other objects have also been achieved by providing a connection of two motor vehicle body members, comprising: a motor vehicle body cross member; a motor vehicle body side member defining an undercut on a side facing said cross member; a connection piece including a mounting area for mounting the cross member, said connection piece being cast onto said side member such that a portion of the connection piece extends into the undercut of the side member to connect the connection piece with the side member; and said cross member being mounted on said mounting area of the connection piece.

Because of the last-solidifying core area, the connection piece contracts in the area around the undercut of the first component during the solidification such that a tensioning effect of very high forces occurs which, when the connection piece is completely solidified, leads to an extremely stable connection between the first component and the connection piece. The last-solidifying core area is determined by heat transfer factors which are known in the art. For example, the solidification front migrates as a function of the direction of heat loss from the outside to the inside. A variation in the surface-to-volume ratio of different areas of the connection piece affects solidification, since an area with a higher surface-to-volume ratio will solidify more quickly than an area with a lower surface-to-volume ratio. The solidification pattern may also be influenced with other measures, such as cooling specific areas to speed up solidification, or by insulating partial areas of the mold.

According to the invention, the second component is then mounted on the connection piece, whereby the two components are connected with one another in a simple manner. Thus, according to the selected shape of the connection piece, a linking of the second component to the first component takes place in an arbitrary manner.

Other objects, advantages and novel features of the present invention will become apparent from the following detailed description of the invention when considered in conjunction with the accompanying drawings.

DETAILED DESCRIPTION OF THE DRAWINGS

Figure 1:
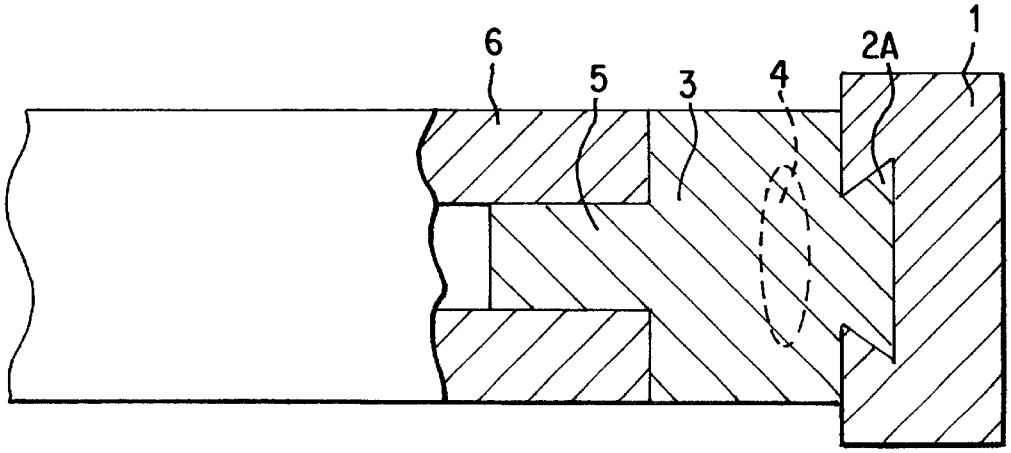
FIG. 1 is a partially sectional view of two components connected according to a first preferred embodiment of the present invention.
Figure 2:
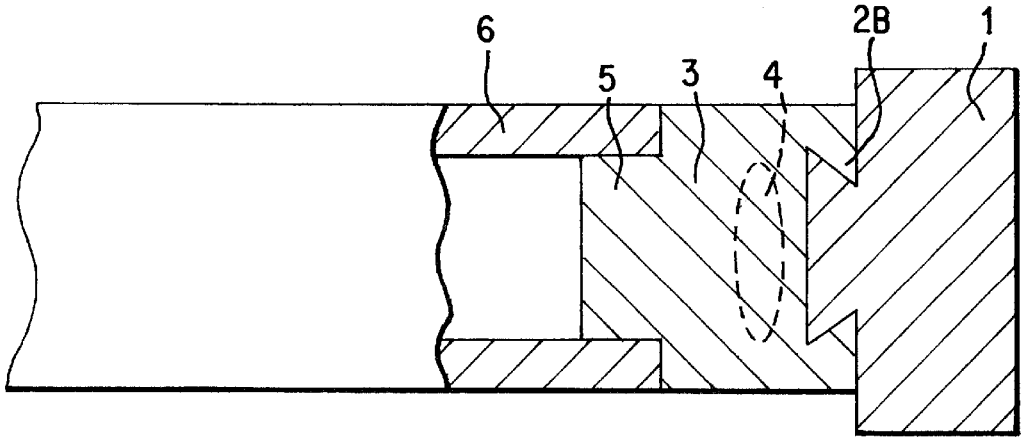
FIG. 2 is a partially sectional view of two components connected according to a second embodiment of the present invention.
Figure 3:
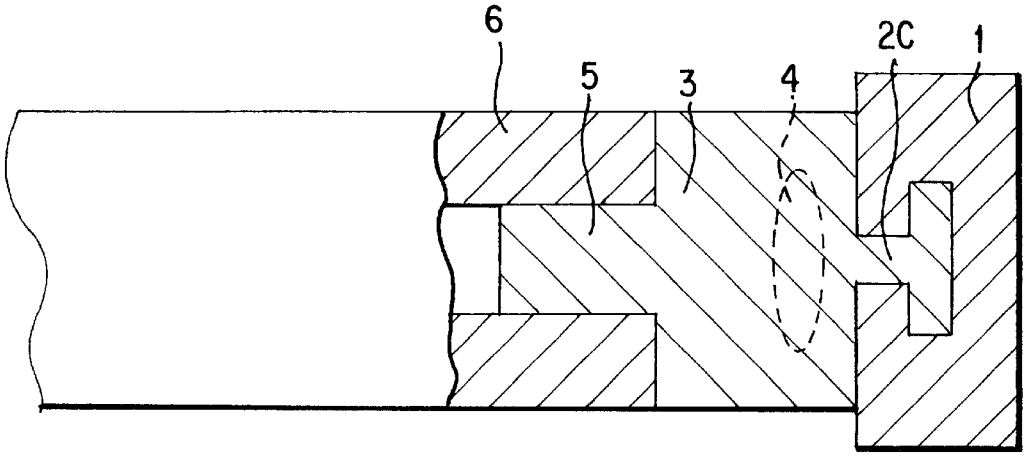
FIG. 3 is a partially sectional view similar to the embodiment of FIG. 1, with a T-slot undercut.
Figure 4:
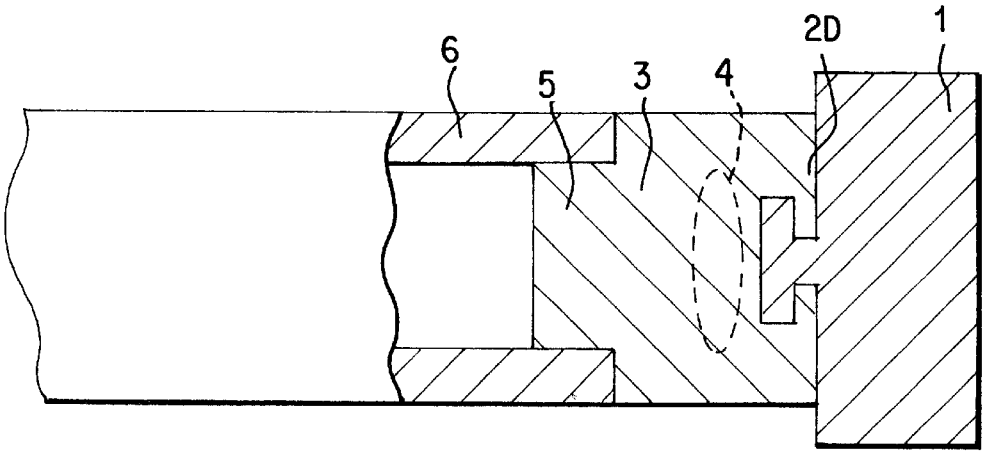
FIG. 4 is a partially sectional view similar to the embodiment of FIG. 2, with a T-slot undercut.

FIGS. 1–4 each show a first component constructed as a side member 1 of a vehicle body which is not shown as a whole. The side member 1 extends in the longitudinal direction of the vehicle body, for example, on a roof side, and has an undercut 2A, 2B, 2C or 2D on its lateral surface. In FIGS. 1 and 2, the undercuts 2A, 2B are constructed as dovetail guides which are known per se. In FIGS. 3 and 4, the undercuts are constructed as T-slots. Other constructions of the undercut 2 are also contemplated. The undercut 2A, 2B, 2C or 2D may only be provided in a partial range of the length of the side member 1, but, for manufacturing reasons, usually extends along its whole length.

In the area of the undercut 2A–2D, a casting mold is placed over a portion of the length of the side member 1, into which casting mold liquid metal will then be poured for forming a connection piece 3. Depending on the casting process used, the casting mold may be constructed in a manner known per se as a sand casting mold, a permanent casting mold or a diecasting mold.

The connection piece 3 and the undercut 2A–2D are designed and mutually adapted such that, during the solidification of the molten metal, a last-solidifying core area 4 of the connection piece 3 contracts the portion of the connection piece 3 situated in the undercut 2A–2D so that, as the result of the forming tensions, the connection piece 3 is firmly connected with the component 1. The last-solidifying core area 4 solidifies last because the solidification front migrates from the outside to the inside of the connection piece, and because the surface-to-volume ratio of the portion of the connection piece 3 including the core area 4 is smaller than the surface-to-volume ratio of the undercut area 2A or the mounting area 5 (since the cross section is largest in the portion of the connection piece 3 including the core area 4). The solidification pattern may also be influenced with other measures, such as cooling specific areas to speed up solidification, or by insulating partial areas of the mold.

In other words, the forces resulting from the contraction of the last-solidifying core area 4 extend precisely such that a very high tensioning effect is generated between the connection piece 3 and the side member 1. The corresponding design of the undercut 2A–2D and of the connection piece 3 can be determined, for example, by tests or computer simulation.

Subsequently, in a mounting area 5 of the connection piece 3 facing away from the component 1, a second component 6, in this case, a cross member 6 of the vehicle body, is mounted on the connection piece 3. This may take place by proven connection processes, such as screwing or welding. If the cross member 6 is welded to the connection piece 3, clearly fewer and also smaller weld seams are required than if the cross member 6 is welded directly to the side member 1, which is done in the prior art. The results are fewer distortions and a much lower warping in the two components 1 and 6.

In the illustrated cases, the second component 6 abuts on the first component 1 in a T-shape. As required, by means of the connection piece 3, components of arbitrary angles with respect to one another can also be connected, in which case the connection piece 3 may also be bent. The second component 6 may be cylindrical, rectangular or of any other cross-section. Naturally, the mounting area 5 of the connection piece 3 will then be adapted to the corresponding cross-section of the second component 6. For example, the mounting area 5 of the correction piece 3 facing away from the undercut 2 can be cast in a cylindrical or parallelepiped shape.

In contrast to the co-called negative undercut 2 illustrated in FIGS. 1 and 3, FIGS. 2 and 4 illustrate a side member 1 with a so-called positive undercut 2B, 2D. During the casting, the connection piece 3 adapts in both cases to the corresponding undercut 2A–2D and, as explained above, because of last-solidifying core area 4, results in a firm connection between the first component 1 and the connection piece 3.

Figure 5:
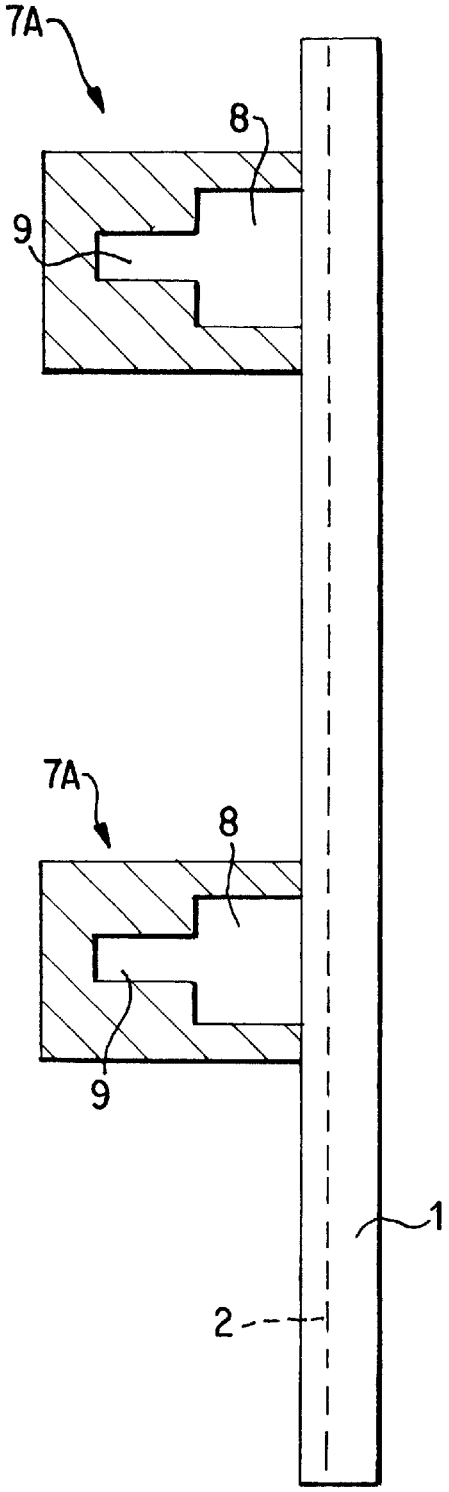
FIG. 5 is a schematic, partially sectional view taken from above of two separate casting molds arranged on the side member.

According to any of the described embodiments, several casting molds 7A may be mounted on the side member 1 shown in FIG. 5, whereby several identical connection pieces 3 can be produced and several cross members 6 can be mounted on a side member 1. The molds 7A each include a mold space 8 defining the main body of the connection piece 3 and a mold space 9 defining the portion 5 of the connection piece 3 for connection to the cross member 6.

Figure 6:
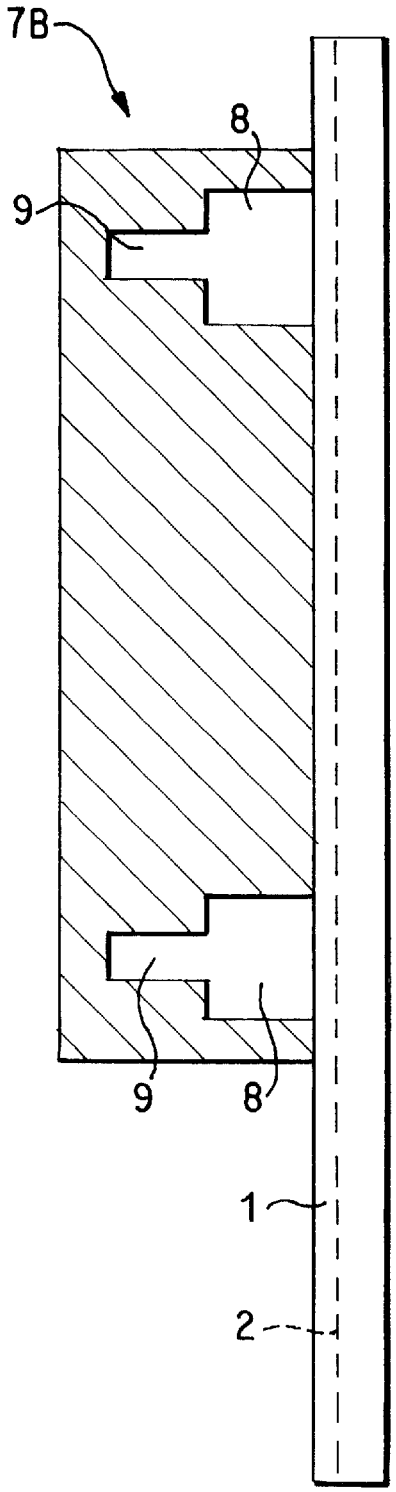
FIG. 6 is a schematic, partially sectional view taken from above of one casting mold with mold spaces for two connection pieces, arranged on the side member.

As an alternative, a casting mold 7B is also contemplated by which two or several connection pieces 3 can be cast onto a side member 1 by means of a single cast, for example as shown in FIG. 6. Several cross members 6 can be mounted on a side member 1 also in this manner.

The described process can be carried out in the case of all known casting processes and alloys or materials. The method of the mounting of the cross member 6 on the connection piece 3 may vary according to the material.

During the casting or the producing of the casting mold, attention should be paid to the fact that it must be possible to separate the casting mold after the casting even in the case of a bent connection piece 3.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for connecting a first motor vehicle component to a second motor vehicle component, the first component having an undercut on a side facing the second component, said process comprising the steps of:

casting a connection piece onto said first component such that a portion of the connection piece extends into the undercut of the first component and a last-solidifying core area which contracts to firmly connect the connection piece with the first component is formed in the connection piece; and subsequently mounting the second component on the connection piece.

2. A process according to claim 1, wherein the first motor vehicle component is a body cross member and the second motor vehicle component is a body side member.

3. A process according to claim 1, wherein several of said connection pieces are successively cast onto the first component by use of the same casting mold.

4. A process according to claim 1, wherein the undercut is a dovetail guide.

5. A process according to claim 1, wherein the undercut is a T-slot.

6. A process according to claim 1, wherein a sand casting mold is used in said casting step.

7. A process according to claim 1, wherein a permanent mold is used in said casting step.

8. A process according to claim 1, wherein the second component is mounted on an area of the connection piece facing away from the undercut.

9. A process according to claim 8, wherein the area of the connection piece facing away from the undercut is cast in a cylindrical shape during said casting step.

10. A process according to claim 8, wherein the area of the connection piece facing away from the undercut is cast in a parallelepiped shape during said casting step.

11. A process according to claim 1, wherein the second component is screwed to the connection piece during said mounting step.

12. A process according to claim 1, wherein the second component is welded to the connection piece during said mounting step.

13. A process according to claim 1, wherein the second component is a cross member for a motor vehicle, and said first component is a side member for the motor vehicle, said cross member abutting in a T-shape on said side member.

14. A process according to claim 1, wherein a diecasting mold is used in said casting step.

15. A process for connecting a motor vehicle body cross member to a motor vehicle body side member, said side member defining an undercut on a side facing said cross member, said process comprising:

arranging a casting mold adjacent said undercut, said casting mold defining at least one mold space for forming a connection piece including a mounting area for mounting the cross member;

flowing a molten material into said at least one mold space of the casting mold to form said connection piece, a portion of the molten material flowing into the undercut of the side member to form a connection between the connection piece and the side member after the molten material solidifies; and mounting said cross member on said mounting area of the connection piece.

16. A process according to claim 15, wherein a last-solidifying core area of said connection piece contracts to firmly connect the connection piece with the side member.

17. A process according to claim 15, wherein the mounting of said cross member on said mounting area of the connection piece occurs subsequent to the flowing of the molten material into the at least one mold space of the casting mold.

* * * * *